US010994169B2

(12) United States Patent
Marzano

(10) Patent No.: US 10,994,169 B2
(45) Date of Patent: May 4, 2021

(54) METHOD OF RESISTANCE TRAINING UTILIZING EDDY CURRENT RESISTANCE

(71) Applicant: Velocity Magnetics, Inc., New Castle, PA (US)

(72) Inventor: Terry Joseph Marzano, Youngstown, OH (US)

(73) Assignee: Velocity Magnetics, Inc., New Castle, PA (US)

( * ) Notice: Subject to any disclaimer, the term of this patent is extended or adjusted under 35 U.S.C. 154(b) by 14 days.

(21) Appl. No.: 16/517,953

(22) Filed: Jul. 22, 2019

(65) Prior Publication Data

US 2020/0023220 A1 Jan. 23, 2020

Related U.S. Application Data

(60) Provisional application No. 62/701,140, filed on Jul. 20, 2018.

(51) Int. Cl.
*A63B 21/005* (2006.01)

(52) U.S. Cl.
CPC ..... *A63B 21/0052* (2013.01)

(58) Field of Classification Search
CPC ..... A63B 21/0052; A63B 21/00192; A63B 2220/58; A63B 21/0053; A63B 21/0054; A63B 21/0055; A63B 21/0056; A63B 21/0057; A63B 21/0058; A63B 21/0059; H02K 49/04; H02K 49/043; H02K 49/046

See application file for complete search history.

(56) References Cited

U.S. PATENT DOCUMENTS 10,065,062 B2 * 9/2018 Stewart ..... A63B 22/0664
2006/0278478 A1 * 12/2006 Pribonic ..... B61H 7/083 188/159
2015/0288272 A1 * 10/2015 Tzeng ..... A63B 21/4045 310/93

* cited by examiner

*Primary Examiner* — Nyca T Nguyen
*Assistant Examiner* — Andrew M Kobylarz
(74) *Attorney, Agent, or Firm* — The Webb Law Firm

(57) ABSTRACT

A method of utilizing eddy currents to induce resistance that simulates and replaces physical weights in strength training exercise equipment includes a user moving at least one of a first member and a second member that supports magnets of alternating polarity, relative to each other bi-directionally. The bi-directional movement can be linear, radial, arcuate, or circular. The movement of the first member and a second member relative to each other induces in the first member eddy currents which resist the movement of the first member, the second member, or both bi-directionally.

20 Claims, 6 Drawing Sheets

METHOD OF RESISTANCE TRAINING UTILIZING EDDY CURRENT RESISTANCE

CROSS-REFERENCE TO RELATED APPLICATION

This application claims the benefit of U.S. Provisional Patent Application No. 62/701,140, filed Jul. 20, 2018, the contents of which are incorporated herein by reference.

BACKGROUND OF THE INVENTION

Field of the Invention

The present invention relates generally to resistance training and, more particularly, to a method of resistance training utilizing eddy currents to provide resistance.

Background of the Invention

Current strength training exercise equipment typically utilize physical weights as the means of creating resistance. Drawbacks of such current strength training exercise equipment include: the use of physical weights can result in equipment that can be difficult to move due to the weights used with the equipment; physical weights can pose as a safety hazard to users if they are located under the weights during the exercise and become unable to continue lifting the weights; and dropping physical weights can result in damage to the exercise equipment itself, as well as the flooring.

SUMMARY OF THE INVENTION

Generally, provided, in some non-limiting embodiments or examples, is a method of resistance training that that utilizes magnets and eddy current braking forces to simulate weights in strength training exercise equipment that overcomes the drawbacks described above.

In some non-limiting embodiments or examples, being able to induce resistance using eddy currents generated using magnets, albeit permanent magnets, electromagnets, or some combination of permanent magnets and electromagnets, in strength training exercise equipment, can reduce or avoid the need for physical weights. This can reduce the overall weight and size of equipment that may incorporate said physical weights making the equipment easier to move. The use of eddy current resistance to simulate the resistance of physical weights during resistance strength training can also or alternatively result in increased safety for the user because minimal force can be used to overcome the resistance during a particular exercise in the event a user is no longer able to apply a force sufficient to overcome the force of the eddy current resistance. Moreover, in the event that equipment is dropped, the resistance or braking effect caused by the eddy currents will cause the equipment to slowly lower to a rest position, such as the ground, reducing the risk of damage to the equipment and flooring. The use of eddy current resistance also allows for the equipment to move bi-directionally in order to allow the user to exercise in both directions of movement. The use of magnets and an air gap to produce eddy currents can allow for the resistance of the equipment to be adjusted by altering the size of the air gap through manual devices or methods.

In some non-limiting embodiments or examples, a plate or fin moves in a bi-directional linear motion between two panels of one or more magnets to generate eddy current resistance that simulates and replaces the use of physical weights.

In some non-limiting embodiments or examples, the plate or fin moves in a bi-directional radial, circular, or semi-circular motion between two panels of one or more magnets to generate eddy current resistance that simulates the use of physical weights.

In some non-limiting embodiments or examples, a rod moves in a bi-directional linear motion through the center of one or more magnets to generate eddy current resistance that simulates the use of physical weights.

In some non-limiting embodiments or examples, a reaction plate is moved in a bi-directional linear motion across one panel of one or more magnets to generate eddy current resistance that simulates and replaces the use of physical weights.

BRIEF DESCRIPTION OF THE DRAWINGS

These and other features of the present invention will become more apparent from the following description in which reference is made to the appended drawings wherein.

DESCRIPTION OF THE INVENTION

Non-limiting embodiments or examples will now be described with reference to the accompanying figures where like reference numbers correspond to like or functionally equivalent elements.

Figure 1:
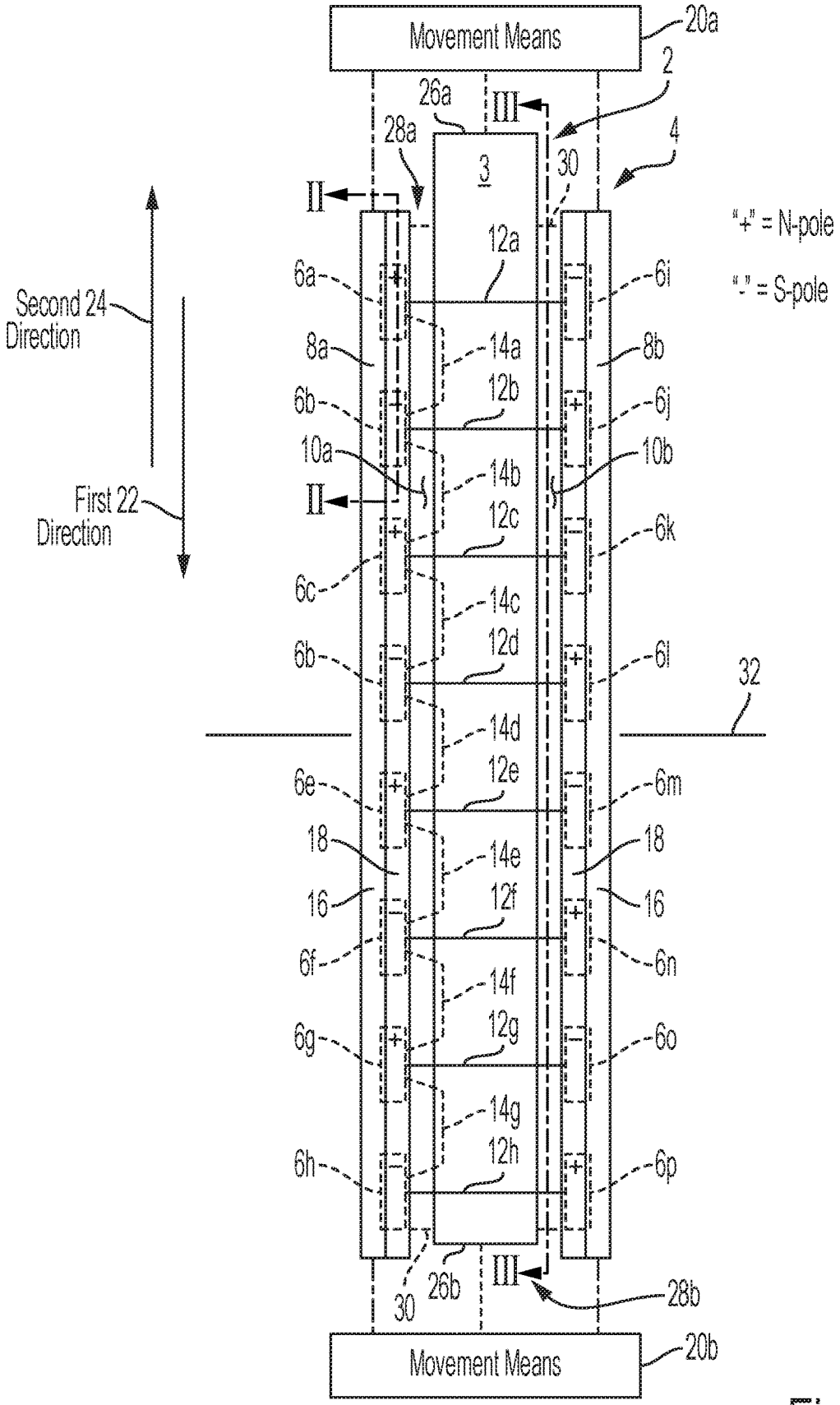
FIG. 1 is a side view of a non-limiting embodiment or example eddy current resistance system according to the principles of the present invention.
Figure 2:
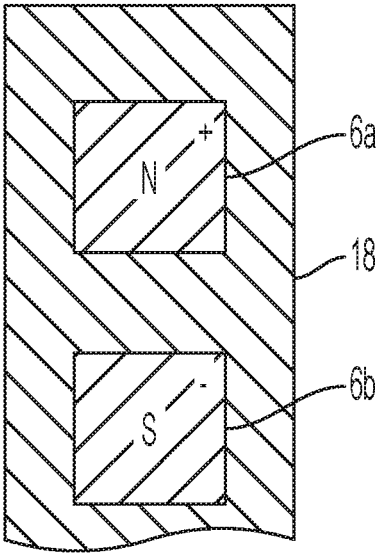
FIG. 2 is a view taken along lines II-II in FIG. 1.
Figure 3:
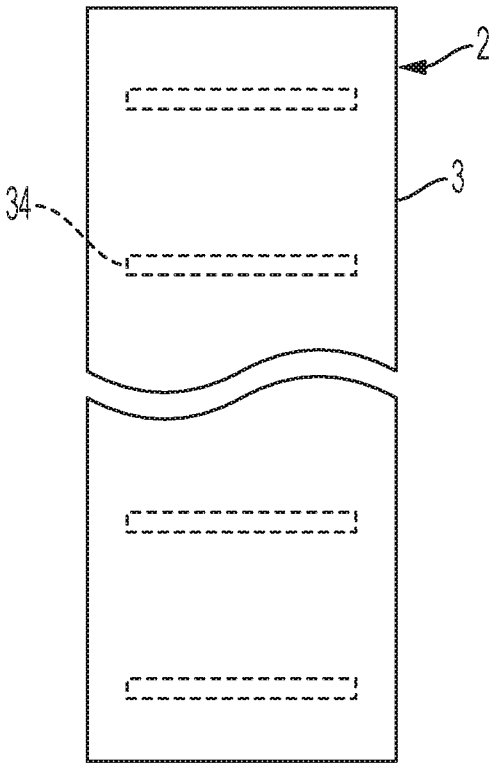
FIG. 3 is a view taken along lines III-III in FIG. 1.

With reference to FIGS. 1-3, according to some non-limiting embodiments or examples, provided is a method of utilizing eddy current resistance in strength training exercise equipment in a linear direction. In some non-limiting embodiments or examples, the eddy current resistance can be provided by an eddy current device that includes a first member 2, which, in an example, can be a flat metallic plate 3, sometimes referred to as a brake fin, made of a non-ferrous metal. In some non-limiting embodiments or examples, first member 2 can be disposed proximate a second member 4 that includes an array of at least two spaced magnets 6 arranged in alternating polarity. In some non-limiting embodiments or examples, second member 4 can include one or more parts or panels 8, each supporting one or more magnets 6. In the non-limiting embodiment or example shown in FIGS. 1-3, second member 4 includes panels 8*a* and 8*b* in spaced relation with first member 2 positioned between panels 8*a* and 8*b*, with an air gap 10*a* between panel 8*a* and first member 2 and an air gap 10*b* between panel 8*b* and first member 2. In some non-limiting embodiments or examples, panels 8*a* and 8*b* can be held in spaced relation by a support 30. While second member 4 comprising panels 8*a* and 8*b* is described, this is not to be construed in a limiting sense since the use of first member 2 with second member 4 consisting of a single panel 8*a* or 8*b* is envisioned.

In some non-limiting embodiments or examples, as shown in FIG. 1, each panel 8*a* and 8*b* can include a one or more magnets 6. In an example, panel 8*a* can include eight magnets 6*a*-6*h* of alternating "+" and "−" polarities and panel 8*b* can include eight magnets 6*i*-6*p* of alternating polarities. In the example shown in FIG. 1, the polarity of the face of each magnet 6 facing first member 2 is indicated by a "+" sign for a north magnetic pole and a "−" for a south magnetic pole. In some non-limiting embodiments or examples, as shown in FIG. 1, the faces of the magnets 6 on opposite sides of first member 2, e.g., magnets 6*a* and 6*i*, can have different or alternating polarities. For example, the face of magnet 6*a* facing first member 2 has a "+" polarity indicating a north magnetic pole while the face of magnet 6*i* facing first member 2 has a "−" polarity indicating a south magnetic pole.

In some non-limiting embodiments or examples, where second member 4 includes panels 8*a* and 8*b*, each having one or more magnets 6, magnetic flux 12 can extend in the gaps 10*a* and 10*b* and through first member 2, when present, between magnets on opposite sides of first member 2. For example, magnetic flux 12*a*-12*h* can run at least between magnet pairs (6*a*, 6*i*), (6*b*, 6*j*), (6*c*, 6*k*), (6*d*, 6*l*), (6*e*, 6*m*), (6*f*, 6*n*), (6*g*, 6*o*), and (6*h*, 6*p*), respectively. However this is not to be construed in a limiting sense since magnetic flux can also run between one or more other pairs of magnets 6 depending on the magnetic reluctance along the path between said pairs of magnets 6.

In some non-limiting embodiments or examples, where second member 4 includes only a single panel 8*a*, magnetic flux 14 can extend in the gap 10*a* and in first member 2, when present, between adjacent or proximate pairs of magnets. This is shown in FIG. 1 by magnetic flux 14*a*-14*g* running between magnet pairs (6*a*, 6*b*), (6*b*, 6*c*), (6*c*, 6*d*), (6*d*, 6*e*), (6*e*, 60, (6*f*, 6*g*), and (6*g*, 6*h*), respectively. Of course, magnetic flux 14 can run between magnet pairs of panels 8*a* and 8*b* if present on opposite sides of first member 2.

In some non-limiting embodiments or examples, each panel 8 can be formed in any suitable and/or desirable manner and of any suitable and/or desirable material(s) that can support magnets 6 in the manner shown in FIG. 1 and relative to first member 2. In some non-limiting embodiments or examples, each panel 8 an be formed of a backing plate 16 made of ferromagnetic material, such as steel, and a cover plate 18 made of non-ferromagnetic material, such as Al or Cu. Each magnet 6 can be sandwiched between backing plate 16 and cover plate 18 which, in some non-limiting embodiments or examples, can include, for each magnet 6, at least one or more recesses (not specifically shown) for receiving and supporting said magnet 6 stationary between backing plate 16 and cover plate 18.

First Use of the Eddy Current Device;

In some non-limiting embodiments or examples, in a first use of the eddy current device shown in FIG. 1, a user applies, via one or more movement means 20*a* and/or 20*b*, force(s) to one or more ends 26*a* and/or 26*b* of first member 2 to move it bi-directionally, initially in a first direction 22 and then in a second, opposite direction 24, in the flux 12 and/or 14 generated by two or more magnets 6 of second member 4 thereby creating or inducing in first member 2 eddy currents that resist movement of first member 2 in both directions of movement. In this example, second member 4 is stationary and movement of first member 2 in the first and second directions is assumed to be linear.

Second Use of the Eddy Current Device;

In some non-limiting embodiments or examples, in a second, additional or alternative use of the eddy current device shown in FIG. 1, a user applies, via one or more movement means 20*a* and/or 20*b* connected to one or more ends 28*a* and/or 28*b* of second member 4, force(s) to move second member 4 bi-directionally, initially in first direction 22 and then in the second, opposite direction 24, whereupon magnetic flux 12 and/or 14 generated by two or more magnets 6 creates or inducing in first member 2 eddy currents that resist movement of second member 4 in both directions of movement. In this example, first member 2 is stationary and movement of second member 4 in the first and second directions is assumed to be linear.

Third Use of the Eddy Current Device;

In some non-limiting embodiments or examples, in a third, additional or alternative use of the eddy current device shown in FIG. 1, a user applies, via movement means 20*a* and/or 20*b*, force(s) to end 26*a* of first member 2 and end 28*b* of second member 4 to simultaneously move first member 2 in first direction 22 in the magnetic flux 12 and/or 14 and to move second member 4 in second direction 24, thereby moving the magnetic flux 12 and/or 14 that passes through first member 2. The movement of first member 2 in the magnetic flux 12 and/or 14 and the movement of the magnetic flux 12 and/or 14 in first member 2 caused by moving second member 4 creates in first member 2 eddy currents that simultaneously resist movement of first member 2 in the first direction 22 and resist movement of second member 4 in in the second direction 24.

Thereafter, the user reverses the movements of first and second member 2 and 4. More specifically, via one or more movement means 20*a* and/or 20*b*, the user simultaneously applies force(s) to move first member 2 in second direction 24 in the magnetic flux 12 and/or 14 and move second member 4 in first direction 24, thereby moving the magnetic flux 12 and/or 14 that passes through first member 2. The movement of first member 2 in the magnetic flux 12 and/or 14 and the movement of the magnetic flux 12 and/or 14 in first member 2 caused by moving second member 4 creates in first member 2 eddy currents that simultaneously resist movement of first member 2 in the second direction 24 and resist movement of second member 4 in in the first direction 22. In this example, movement in the first and second directions is assumed to be linear.

In some non-limiting embodiments or examples, each movement means 20 described herein can be any suitable and/or desirable element that enables a user to manipulate and move first member 2 and/or second member 4. A non-limiting example of movement means 20 can include a single movement means 20*a*, e.g., in the form of a bar, gripped by the user and used for a pressing motion, e.g., a bench or overhead press, when moved in first direction 22 (or second direction 24) and a pulling motion, e.g., a rowing or pullup motion, when moved in second direction 24 (or first direction 22). In another example, movement means 20 can include movement means 20*a* and 20*b* for an exercise that requires a user to manipulate separate elements. Non-limiting examples of the latter exercise can include, for movement means 20*a* and 20*b*, separate handles that can be gripped by the hands of the user and used for chest (or forward) butterflies when moved in first direction 22 (or second direction 24) and a back (or reverse) butterfly when moved in the second direction 24 (or first direction 22). In an example, each movement means 20 can be coupled in any suitable and/or desirable manner or means, such as a flexible cable or a rigid member, as may be appropriate for the design of the exercise machine incorporating the eddy current devise.

The total resistance experienced by a user of the eddy current device will depend on the material(s) used to form first member 2, the intensity or strength of magnetic flux produced by the magnets 6, the number of magnets 6 used, the size of the air gap(s) 10 between the first member 2 and magnets 6, and the force(s) applied by the user. In some non-limiting embodiments or examples, the resistance can be adjusted by adjusting the size of one or both air gaps 10*a* and/or 10*b*. In an example, the size of each air gap 10 can be adjusted using a manual device, such as, for example, a knob that can be rotated to cause at least one of the panels 8 to move farther from or closer to first member 2.

In another example, where one or more magnets 6 are electromagnets, the total resistance experienced by the user of the eddy current device can, also or alternatively, be adjusted by adjusting the current(s) supplied to the one or more electromagnets and, hence, the intensity or strength of magnetic flux produced thereby. Of course, adjustment of the size of the air gap and adjustment of the current(s) supplied to the one or more electromagnets can be used together to adjust the resistance experienced by the user.

In some non-limiting embodiments or examples, plate 3 may include one or more optional transverse slots 34 (shown in phantom in FIG. 3) to aid in increasing the path (and, hence reluctance) that one or more eddy currents induced in plate 3 experience, thereby enhancing the resistance provided by the eddy current device.

In some non-limiting embodiments or examples, the first and second directions 22 and 24 in the examples described above with reference to FIGS. 1-3 can be a full or partial circle or an arc. In this example, first member 2 can be an arcuate or circular plate 3 and each provided panel 8 (8*a* and, if provided, 8*b*) can also be arcuate or circular with magnets 6 disposed in an arc or circle. In an example, first member 2 or second member 4 (when second member 4 or first member 2, respectively, is stationary) can be fully or partially rotated, via one or more movement means 20, in first direction 22 and then in second direction 24, about a shaft 32 to move first member 2 through magnetic flux 12 and/or 14 or to move second member 4 such that magnetic flux 12 and/or 14 moves though first member 2, respectively. In another example, first and second members 2 and 4 can simultaneously be fully or partially rotated, via movement means 20*a* connected to first member 2 and movement means 20*b* connected to second member 4, about shaft 32 in respective first and second directions 22 and 24 to move first member 2 through magnetic flux 12 and/or 14 and to move second member 4 such that magnetic flux 12 and/or 14 moves though first member 2. Thereafter, the directions of movement of first and second members 2 and 4 can reversed whereupon first and second members 2 and 4 can simultaneously be fully or partially rotated about shaft 32 in first and second members 2 and 4 second and first directions 24 and 22 to move first member 2 through magnetic flux 12 and/or 14 and to move second member 4 such that magnetic flux 12 and/or 14 moves though first member 2.

Figure 4:
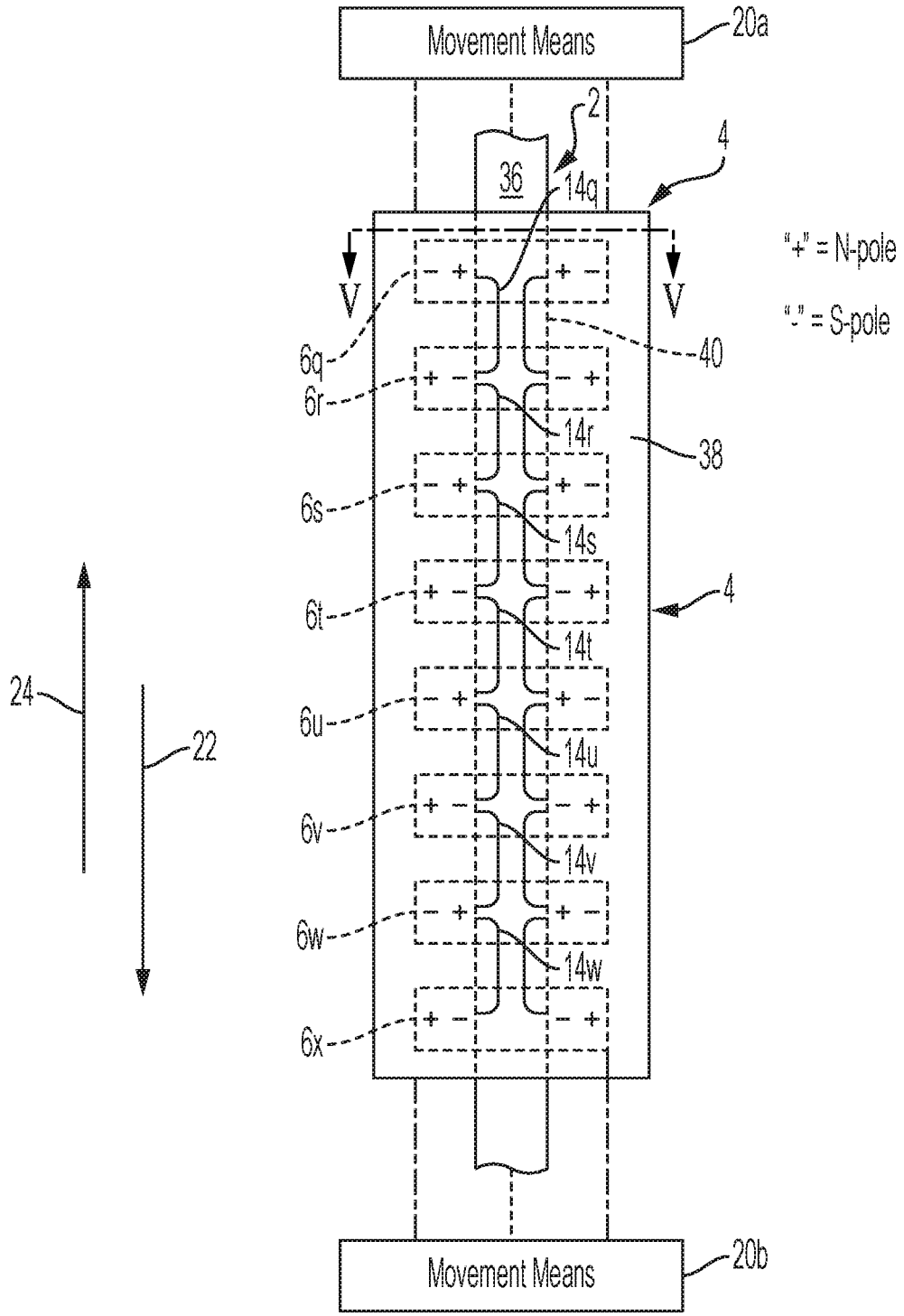
FIG. 4 is a side view of another non-limiting embodiment or example eddy current resistance system according to the principles of the present invention.
Figure 5:
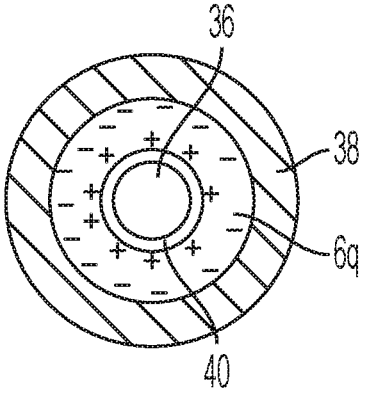
FIG. 5 is a view taken along lines V-V in FIG. 4.

With reference to FIGS. 4-5, in some non-limiting embodiments or examples, eddy current device can include first member 2 in the form of a rod 36, in replacement of plate 3, and second member 4, in the form of an elongated hollow tube or hollow cylinder 38, in replacement of each panel 8, having an elongated hollow center 40 for receiving rod 36. Second member 4 in this example can support at least two spaced, ring shaped magnets 6 of alternating polarity with the axis of each magnet 6 coaxial with the longitudinal axis of center 40 of cylinder 38. In the example shown in FIG. 4, second member 4 includes magnets 6*q*-6*x*, however, this is not to be construed in a limiting sense since, in some non-limiting embodiments or examples, only two ring shaped magnets 6 may be used.

In some non-limiting embodiments or examples, the magnetic polarity of each ring shaped magnet 6 can extend radially. For example, as shown in FIG. 4, magnet 6*q* has a "+" polarity along the inside diameter thereof and a "–" polarity on the outside diameter thereof, whereas magnet 6*r* has a "–" polarity along the inside diameter thereof and a "+" polarity on the outside diameter thereof—the opposite of magnet 6*q*. It is this difference in polarity of adjacent or proximate magnets that provides the alternating polarity.

In some non-limiting embodiments or examples, magnetic flux 14 can extend in the hollow center 40 and in first member 2 (in the form of rod 36) when present in hollow center 40 between adjacent or proximate pairs of magnets. This is shown in FIG. 4 by magnetic flux 14*q*-14*w* running between magnet pairs (6*q*, 6*r*), (6*r*, 6*s*), (6*s*, 6*t*), (6*t*, 6*u*), (6*u*, 6*v*), (6*v*, 6*w*), and (6*w*, 6*x*), respectively.

In some non-limiting embodiments or examples, second member 4 in the form of a hollow tube or hollow cylinder 38 including ring shaped magnets 6 therein can be formed in any suitable and/or desirable manner. In an example, first member 2 in the form of rod 36 can be made from ferromagnetic material and second member 4 in the form of hollow cylinder 38 can be formed at least in part from non-ferromagnetic material.

In some non-limiting embodiments or examples, the method of use of first member 2 in the form of rod 36 and second member 4 in the form of hollow cylinder 38 supporting ring shaped magnets 6 can be similar to the method of use of first member 2 in the form of a plate 3 and second member 4 in the form of one or more panels 8 described above for linear motion between plate 3 and the one or more panels 8 described under the subtitles First Use of The Eddy Current Device, Second Use of The Eddy Current Device, and Third Use of The Eddy Current Device. Accordingly, descriptions of the First Use of The Eddy Current Device, Second Use of The Eddy Current Device, and Third Use of The Eddy Current Device in connection with the eddy current device shown in FIG. 4 including first member 2 in the form of rod 36 and second member 4 in the form of hollow cylinder 38 supporting ring shaped magnets will not be repeated herein to avoid unnecessary redundancy.

Figure 6:
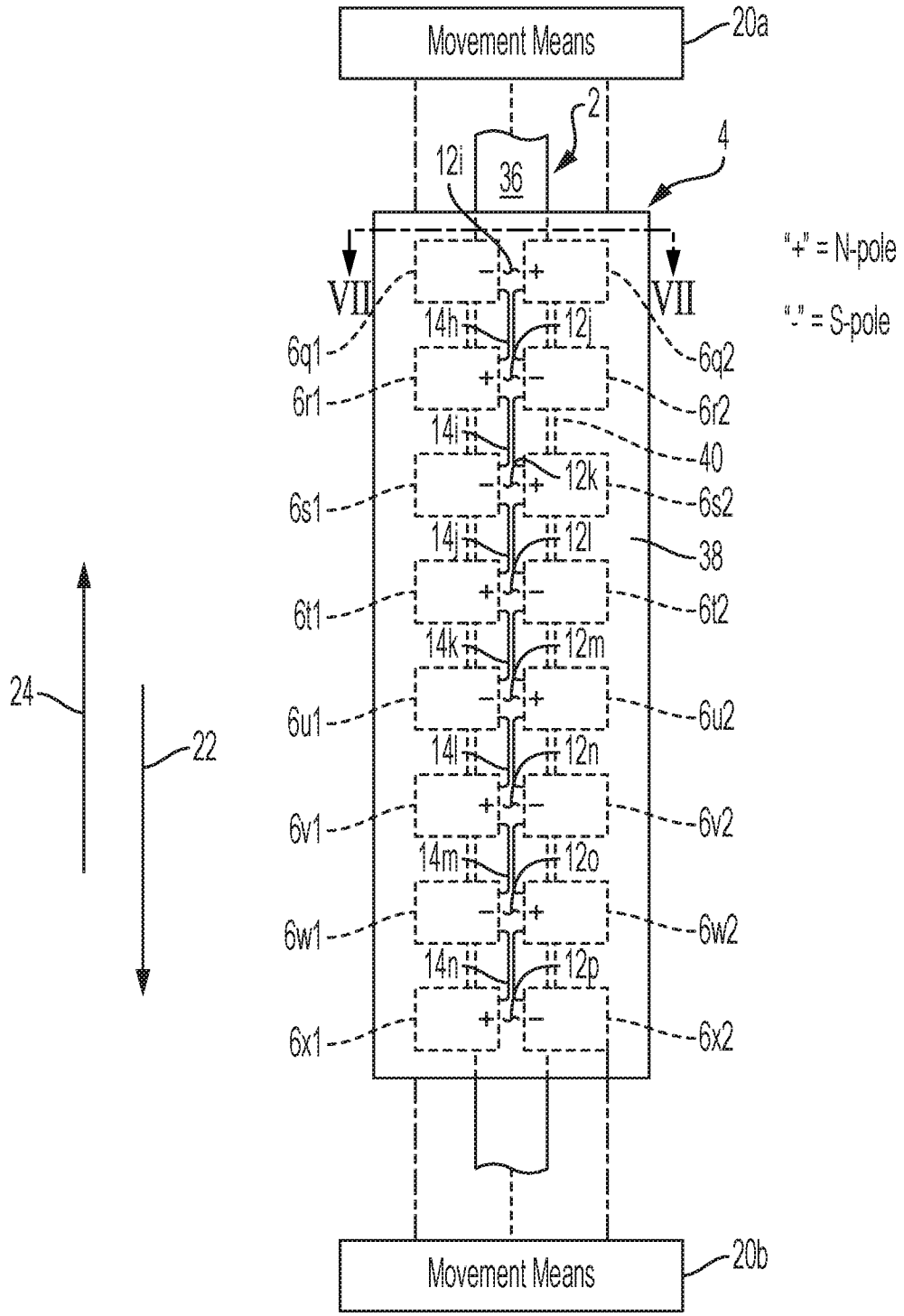
FIG. 6 is a side view of another non-limiting embodiment or example eddy current resistance system according to the principles of the present invention.
Figure 7:
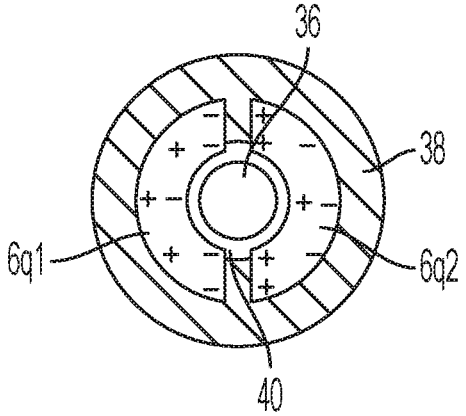
FIG. 7 is a view taken along lines VII-VII in FIG. 6.

With reference to FIGS. 6-7, in some non-limiting embodiments or examples, and except as described hereinafter, the eddy current device shown in FIGS. 6-7 is similar in most respects to the non-limiting embodiment or example eddy current device shown in FIGS. 4-5 and described above with the following exception(s). For each ring shaped magnet 6 in FIGS. 4-5, the non-limiting embodiment or example eddy current device shown in FIGS. 6-7 includes two spaced facing arcuate shaped magnets 6 of alternating polarity. In an example, second member 4 in FIG. 6 includes an array of at least two spaced facing arcuate shaped magnets 6.

In some non-limiting embodiments or examples, as shown in FIG. 6, second member 4 in the form of a hollow tube or hollow cylinder 38 includes eight pairs of magnets of alternating polarity, e.g., (6*q*1, 6*q*2), or two sets of eight magnets 6 each. The first set of magnets includes magnets 6*q*1-6*x*1 of alternating polarity and the second set of magnets includes magnets 6*q*2-6*x*2 of alternating polarity. As shown in FIG. 6, the faces of magnets 6 on opposite sides of hollow center 40, e.g., magnets 6*q*1 and 6*q*2, can have different or alternating polarities.

In some non-limiting embodiments or examples, as shown in FIG. 6, magnetic flux can extend through opening 40 and through rod 36, when present, between magnets on opposite sides of opening 40. For example, magnetic flux 12*i*-12*p* can run at least between magnet pairs (6*q*1, 6*q*2), (6*r*1, 6*r*2), (6*s*1, 6*s*2), (6*t*1, 6*t*2), (6*u*1, 6*u*2), (6*v*1, 6*v*2), (6*w*1, 6*w*2), and (6*x*1, 6*x*2), respectively. However this is not to be construed in a limiting sense since magnetic flux 12 can also run between one or more other pairs of magnets 6 depending on the magnetic reluctance along the path between said pairs of magnets 6.

In some non-limiting embodiments or examples, magnetic flux 14 can also or alternatively extend in opening 40 and in rod 36, when present, between adjacent or proximate pairs of magnets 6 within tube or hollow cylinder 38. This is shown in FIG. 1 by magnetic flux 14*h*-14*n* running between magnet pairs (6*q*1, 6*r*1), (6*r*1, 6*s*1), (6*s*1, 6*t*1), (6*t*1, 6*u*1), (6*u*1, 6*v*1), (6*v*1, 6*w*1), and (6*w*1, 6*x*1), respectively. Magnetic flux (shown but not labeled in FIG. 6) can also extend adjacent or proximate magnetic flux 14*h*-14*n* between adjacent or proximate magnet pairs (6*q*2, 6*r*2), (6*r*2, 6*s*2), (6*s*2, 6*t*2), (6*t*2, 6*u*2), (6*u*2, 6*v*2), (6*v*2, 6*w*2), and (6*w*2, 6*x*2).

Second member 4 in FIG. 6 supports at least two pair of spaced, arcuate shaped magnets 6 of alternating polarity, with the magnets of each pair, e.g., 6*q*1 and 6*q*2, positioned on opposite sides of hollow center 40. In the example shown in FIG. 6, second member 4 includes magnets 6*q*1-6*x*1 and 6*q*2-6*x*2, however, this is not to be construed in a limiting sense since, in some non-limiting embodiments or examples, only two pair of arcuate shaped magnets 6 may be used.

In some non-limiting embodiments or examples, the use of first member 2 in the form of rod 36 and second member 4 in the form of hollow cylinder 38 supporting arcuate shaped magnets is similar to the use of first member 2 in the form of a plate 3 and second member 4 in the form of one or more panels 8 described above for linear motion between plate 3 and the one or more panels 8 described under the subtitles First Use of The Eddy Current Device, Second Use of The Eddy Current Device, and Third Use of The Eddy Current Device. Accordingly, descriptions of the First Use of The Eddy Current Device, Second Use of The Eddy Current Device, and Third Use of The Eddy Current Device in connection with the eddy current device shown in FIG. 6 including first member 2 in the form of rod 36 and second member 4 in the form of hollow cylinder 38 supporting arcuate shaped magnets will not be repeated herein to avoid unnecessary redundancy.

As can be seen, disclosed herein, in some non-limiting embodiments or examples, is a method of resistance training with an eddy current device that includes a first member 2 and a second member 4. The second member 4 includes an array of at least two spaced magnets 6 arranged in alternating polarity so as to produce a magnetic flux 12 and/or 14 in a space 10, 40 proximate the second member 4. The method includes a user, at a first point in time, moving the first member 2 in a first direction 22 in the magnetic flux thereby inducing in the first member 2 a first set of eddy currents that resist movement of the first member 2 in the first direction 22. Next, the user, at a second, later point in time, moving the first member 2 in a second, opposite direction 24 in the magnetic flux 12 and/or 14 thereby inducing in the first member 2 a second set of eddy currents that resist movement of the first member 2 in the second direction 24.

Also disclosed, in some non-limiting embodiments or examples, is a method of resistance training with an eddy current device that includes a first member 2 and a second member 4. The second member 4 includes an array of at least two spaced magnets 6 arranged in alternating polarity so as to produce a magnetic flux 12 and/or 14 in a space 10, 40 proximate the second member 4. The method includes the user, at a first point in time, moving the second member 4 in a first direction 22 thereby moving the magnetic flux in the first direction in the first member 2 inducing in the first member 2 a first set of eddy currents that resist movement of the second member 4 in the first direction. Next, at a second, later point in time, the user moves the second member 4 in a second, opposite direction thereby moving the magnetic flux in the second direction in the first member 2 inducing in the first member 2 a second set of eddy currents that resist movement of the second member 2 in the second direction 24.

Also disclosed, in some non-limiting embodiments or examples, is a method of resistance training with an eddy current device that includes a first member 2 and a second member 4. The second member 4 includes an array of at least two spaced magnets 6 arranged in alternating polarity so as to produce a magnetic flux 12 and/or 14 in a space 10, 40 proximate the second member 4. The method includes the user, at a first point in time, simultaneously moving the first member 2 in a first direction 22 in the magnetic flux and the second member 4 in a second direction 24 thereby moving the magnetic flux in the second direction in the first member, whereupon said simultaneous movement of the first member in the first direction and the second member in the second direction induces in the first member a first set of eddy currents that resist movement of the first member in the first direction and movement of the second member in the second direction. Next, at a second, later point in time, the user simultaneously moves the first member 2 in the second direction 24 in the magnetic flux and the second member 4 in the first direction 22 thereby moving the magnetic flux in the first direction in the first member, whereupon said simultaneous movement of the first member in the second direction and the second member in the first direction induces in the first member a second set of eddy currents that resist movement of the first member in the second direction and movement of the second member in the first direction.

In some non-limiting embodiments or examples, the magnets 6 can be permanent magnets, electromagnets, or a combination of permanent magnets and electromagnets. In some non-limiting embodiments or examples, the array of spaced magnets 6 can be arranged linearly and the first and second directions 22 and 24 can be parallel to the array of spaced magnets arranged linearly.

In some non-limiting embodiments or examples, the second member 4 can include first and second parts 8*a* and 8*b* positioned so as to form the space 10 proximate the second member where the magnetic flux 12 and/or 14 is produced. In some non-limiting embodiments or examples, the array of spaced magnets 6 can include magnets of alternating polarity supported by the respective first and second parts of the second member on opposite sides of the space.

In some non-limiting embodiments or examples, the second member 4 can be a hollow tube or hollow cylinder 38 having an elongated hollow interior. In some non-limiting embodiments or examples, the first member 2 can be elongated, e.g., a rod, and sized to move in the first and second directions in the elongated hollow interior of the tube or cylinder. In some non-limiting embodiments or examples, the array of spaced magnets 6 can include one or more of the following: ring shaped magnets positioned around the elongated hollow interior and along a length of the tube of cylinder, or arcuate shaped magnets positioned on opposite sides of the elongated hollow interior and along a length of the tube or cylinder.

Also disclosed, in some non-limiting embodiments or examples, is a method of utilizing eddy current braking for the purpose of strength or resistance training exercise equipment in a linear direction. A brake fin or plate 3 is utilized which can be a flat metallic plate made of a non-ferrous metal. The brake fin or plate 3 is placed between two panels 8*a*, 8*b* of one or more magnets 6 that are arranged in a linear direction with an air gap 10*a*, 10*b* between the brake fin or plate and each of the panels of magnets. A user applies force to the brake fin or plate to move it in a bi-directional motion linearly between the panels of magnets in order to create eddy current induced resistance in both directions of movement.

Also disclosed, in some non-limiting embodiments or examples, is a method of utilizing eddy current braking for the purpose of strength training exercise equipment in a radial, circular or semi-circular direction. A brake fin or plate can be utilized, which, can be a flat metallic plate made of a non-ferrous metal. The brake fin or plate is placed between two panels of one or more magnets that can be arranged in a radial, circular or semi-circular direction. A user applies force to the brake fin or plate to move it in a bi-directional motion radially, in a circle, or in a semi-circle between the panels of magnets in order to create eddy current induced resistance in both directions of movement. In in some non-limiting embodiments or examples, the magnets are placed in an arc of at least 180°.

Also disclosed, in some non-limiting embodiments or examples, is a method of utilizing eddy current braking for the purpose of strength training exercise equipment utilizing a rod-style arrangement. A rod is utilized which is made of a non-ferrous metal. The rod is either partially or fully surrounded by one or more magnets. A user applies force to the rod to move it through the center of the magnets in a bi-directional motion in order to create eddy current induced resistance in both directions of movement.

Also disclosed, in some non-limiting embodiments or examples, is a method of utilizing eddy current braking for the purposes of strength training exercise equipment utilizing a reaction plate arrangement. The reaction plate is a flat metallic plate made from either a ferrous or non-ferrous metal. One or more magnets are arranged in a linear manner on one side of the reaction plate. An air gap exists between the reaction plate and the magnets. A user applies force to the reaction plate to move the plate in a bi-directional motion across the magnets in a bi-directional motion in order to create eddy current induced resistance in both directions of movement.

In the above described methods, the total resistance experienced by the user of the strength training equipment can depend on the material used to form the brake fin or plate, the intensity or strength of magnetic flux produced by the magnets, the number of magnets used, the size of the air gap between the brake fin and the magnets, and the force that the user applies to the brake fin. The resistance can be adjusted use by adjusting the size of the air gap between the brake fin and the magnets or by changing current(s) supplied to magnet(s) in the form of electromagnet(s). In some non-limiting embodiments or examples, the air gap can be adjusted using manual devices or methods, such as a knob that can be rotated in first and second directions to cause at least one of the panels of magnets to move farther from or closer to the brake fin or plate thereby decreasing or increasing the air gap(s).

Although the invention has been described in detail for the purpose of illustration based on what is currently considered to be the most practical and preferred embodiments, it is to be understood that such detail is solely for that purpose and that the invention is not limited to the disclosed embodiments, but, to the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A method of resistance training with an eddy current device comprising a first member and a second member, the second member including an array of at least two spaced magnets arranged in alternating polarity so as to produce a magnetic flux in a space proximate the second member, wherein each magnet is received in a recess in the second member, the method comprising:

(a) a user moving the first member in a first direction in the magnetic flux thereby inducing in the first member a first set of eddy currents that resist movement of the first member in the first direction; and (b) following step (a), the user moving the first member in a second, opposite direction in the magnetic flux thereby inducing in the first member a second set of eddy currents that resist movement of the first member in the second direction.

2. The method of claim 1, wherein the second member includes first and second parts positioned so as to form the space proximate the second member where the magnetic flux is produced.

3. The method of claim 2, wherein the array of spaced magnets include magnets of alternating polarity supported by the respective first and second parts of the second member on opposite sides of the space.

4. The method of claim 1, wherein the magnets are permanent magnets, electromagnets, or a combination of permanent magnets and electromagnets.

5. The method of claim 1, wherein the array of spaced magnets are arranged linearly; and the first and second directions are parallel to the array of spaced magnets arranged linearly.

6. A method of resistance training with an eddy current device comprising a first member and a second member, the second member including an array of at least two spaced magnets arranged in alternating polarity so as to produce a magnetic flux in a space proximate the second member, wherein each magnet is received in a recess in the second member, the method comprising:

(a) a user moving the second member in a first direction thereby moving the magnetic flux in the first direction in the first member inducing in the first member a first set of eddy currents that resist movement of the second member in the first direction; and (b) following step (a), the user moving the second member in a second, opposite direction thereby moving the magnetic flux in the second direction in the first member inducing in the first member a second set of eddy currents that resist movement of the second member in the second direction.

7. The method of claim 6, wherein the second member includes first and second parts positioned so as to form the space proximate the second member where the magnetic flux is produced.

8. The method of claim 7, wherein the array of spaced magnets include magnets of alternating polarity supported by the respective first and second parts of the second member on opposite sides of the space.

9. The method of claim 6, wherein the magnets are permanent magnets, electromagnets, or a combination of permanent magnets and electromagnets.

10. The method of claim 6, wherein the array of spaced magnets are arranged linearly; and the first and second directions are parallel to the array of spaced magnets arranged linearly.

11. A method of resistance training with an eddy current device comprising a first member and a second member, the second member including an array of at least two spaced magnets arranged in alternating polarity so as to produce a magnetic flux in a space proximate the second member, the method comprising:

(a) a user moving the first member in a first direction in the magnetic flux thereby inducing in the first member a first set of eddy currents that resist movement of the first member in the first direction; and (b) following step (a), the user moving the first member in a second, opposite direction in the magnetic flux thereby inducing in the first member a second set of eddy currents that resist movement of the first member in the second direction, wherein the second member is a tube having an elongated hollow interior; and the first member is elongated and is sized to move in the first and second directions in the elongated hollow interior of the tube.

12. The method of claim 11, wherein the array of spaced magnets includes one of:

ring shaped magnets positioned around the elongated hollow interior and along a length of the tube; and arcuate shaped magnets positioned on opposite sides of the elongated hollow interior and along the length of the tube.

13. A method of resistance training with an eddy current device comprising a first member and a second member, the second member including an array of at least two spaced magnets arranged in alternating polarity so as to produce a magnetic flux in a space proximate the second member, the method comprising:

(a) a user moving the first member in a first direction in the magnetic flux thereby inducing in the first member a first set of eddy currents that resist movement of the first member in the first direction; and (b) following step (a), the user moving the first member in a second, opposite direction in the magnetic flux thereby inducing in the first member a second set of eddy currents that resist movement of the first member in the second direction, wherein the second member is a tube having an elongated hollow interior; and the first member is elongated and is sized to move in the first and second directions in the elongated hollow interior of the tube.

14. The method of claim 13, wherein the array of spaced magnets includes one of:

ring shaped magnets positioned around the elongated hollow interior and along a length of the tube; and arcuate shaped magnets positioned on opposite sides of the elongated hollow interior and along the length of the tube.

15. A method of resistance training with an eddy current device comprising a first member and a second member, the second member including an array of at least two spaced magnets arranged in alternating polarity so as to produce a magnetic flux in a space proximate the second member, wherein each magnet is received in a recess in the second member, the method comprising:

(a) a user simultaneously moving the first member in a first direction in the magnetic flux and the second member in a second direction thereby moving the magnetic flux in the second direction in the first member, whereupon said simultaneous movement of the first member in the first direction and the second member in the second direction induces in the first member a first set of eddy currents that resist movement of the first member in the first direction and movement of the second member in the second direction; and (b) following step (a), the user simultaneously moving the first member in the second direction in the magnetic flux and the second member in the first direction thereby moving the magnetic flux in the first direction in the first member, whereupon said simultaneous movement of the first member in the second direction and the second member in the first direction induces in the first member a second set of eddy currents that resist movement of the first member in the second direction and movement of the second member in the first direction.

16. The method of claim 15, wherein the array of spaced magnets are arranged linearly; and the first and second directions are parallel to the array of spaced magnets arranged linearly.

17. A method of resistance training, with an eddy current device comprising a first member and a second member, the second member including an array of at least two spaced magnets arranged in alternating polarity so as to produce a magnetic flux in a space proximate the second member, the method comprising:

(a) a user simultaneously moving the first member in a first direction in the magnetic flux and the second member in a second direction thereby moving the magnetic flux in the second direction in the first member, whereupon said simultaneous movement of the first member in the first direction and the second member in the second direction induces in the first member a first set of eddy currents that resist movement of the first member in the first direction and movement of the second member in the second direction; and (b) following step (a), the user simultaneously moving the first member in the second direction in the magnetic flux and the second member in the first direction thereby moving the magnetic flux in the first direction in the first member, whereupon said simultaneous movement of the first member in the second direction and the second member in the first direction induces in the first member a second set of eddy currents that resist movement of the first member in the second direction and movement of the second member in the first direction, wherein the second member includes first and second parts positioned so as to form the space proximate the second member where the magnetic flux is produced.

18. The method of claim 17, wherein the array of spaced magnets include magnets of alternating polarity supported by the respective first and second parts of the second member on opposite sides of the space.

19. A method of resistance training with an eddy current device comprising a first member and a second member, the second member including an array of at least two spaced magnets arranged in alternating polarity so as to produce a magnetic flux in a space proximate the second member, the method comprising:

(a) a user simultaneously moving the first member in a first direction in the magnetic flux and the second member in a second direction thereby moving the magnetic flux in the second direction in the first member, whereupon said simultaneous movement of the first member in the first direction and the second member in the second direction induces in the first member a first set of eddy currents that resist movement of the first member in the first direction and movement of the second member in the second direction; and (b) following step (a), the user simultaneously moving the first member in the second direction in the magnetic flux and the second member in the first direction thereby moving the magnetic flux in the first direction in the first member, whereupon said simultaneous movement of the first member in the second direction and the second member in the first direction induces in the first member a second set of eddy currents that resist movement of the first member in the second direction and movement of the second member in the first direction, wherein the second member is a tube having an elongated hollow interior; and the first member is elongated and is sized to move in the first and second directions in the elongated hollow interior of the tube.

20. The method of claim 19, wherein the array of spaced magnets includes one of:

ring shaped magnets positioned around the elongated hollow interior and along a length of the tube; and arcuate shaped magnets positioned on opposite sides of the elongated hollow interior and along the length of the tube.

* * * * *